US009837059B1

(12) United States Patent
Albright

(10) Patent No.: US 9,837,059 B1
(45) Date of Patent: Dec. 5, 2017

(54) DRUM TUNING STABILIZATION SYSTEMS AND METHODS

(71) Applicant: Gary T Albright, Dexter, OR (US)

(72) Inventor: Gary T Albright, Dexter, OR (US)

( * ) Notice: Subject to any disclaimer, the term of this patent is extended or adjusted under 35 U.S.C. 154(b) by 0 days.

(21) Appl. No.: 15/593,088

(22) Filed: May 11, 2017

Related U.S. Application Data

(60) Provisional application No. 62/335,067, filed on May 11, 2016.

(51) Int. Cl.
*G10D 13/02* (2006.01)

(52) U.S. Cl.
CPC ..... *G10D 13/023* (2013.01); *G10D 13/027* (2013.01); *G10D 13/028* (2013.01)

(58) Field of Classification Search
CPC ..... G10D 13/027; G10D 13/028; G10D 3/14
See application file for complete search history.

(56) References Cited

U.S. PATENT DOCUMENTS 6,043,419 A * 3/2000 Arbiter ..... G10D 13/023 84/411 A
2017/0249929 A1* 8/2017 Bedson ..... G10D 13/023

* cited by examiner

*Primary Examiner* — Kimberly Lockett

(57) ABSTRACT

The disclosure includes a drum tuning stabilization system. Some embodiments include a lug housing and a tension rod that extends outwardly from the lug housing. The system can include a locking tube slideably coupled to the tension rod. The system can also include a lever arm rotatably coupled to the locking tube. The lever arm can be arranged and configured to move between a first position and a second position. When the lever arm is in the first position, the locking tube is in a raised position, and when the lever arm is in the second position, the locking tube is in a lowered position. As such, the tension rod can provide downward pressure to a top surface of a swivel hoop, and the locking tube can provide upward pressure to a bottom surface of the swivel hoop to thereby keep a drum in tune.

20 Claims, 9 Drawing Sheets

DRUM TUNING STABILIZATION SYSTEMS AND METHODS

CROSS-REFERENCE TO RELATED APPLICATIONS

This application claims the benefit of U.S. Provisional Patent Application No. 62/335,067; filed May 11, 2016; and entitled DRUM TUNING STABILIZATION SYSTEMS AND METHODS; the entire contents of which are incorporated herein by reference.

BACKGROUND

Field

The present invention relates generally to drum tuning systems, and more particularly to a drum tuning and tuning stabilization mechanism that uses an element to engage a drum hoop.

Description of Related Art

Conventional drum kits are typically uniform in structure. The kits generally include a bass drum, a floor torn, bass drum mounted toms, a side snare drum, a crash symbol, and a high hat. The drums often include a cylindrical drum shell or body covered at each of its open ends with a tightly stretched drum head. The body and drum heads create a resonant cavity that vibrates dramatically with each strike of a drum stick on the drum head. The drum heads are typically round and have a diameter that exceeds that of the openings on the drum body, such that the outer portion of the head can be folded over the sides of the body. The heads can be held on the ends and pulled tight by drum hoops that comprise an annular channel placed over the rim of the body. The hoops can also include an outwardly extending flange through which a plurality of holes are disposed.

The hoops can be bolted to the drum body by lug bolts inserted through the holes in the hoop. The lug bolts often include an underside disposed over the outer surface of the hoop and ends that are threadably inserted into lug casings having a nut to secure the lug bolts in place. Tightening the lug bolt can pull the hoop channel downward onto the drum body. Thus, the lug bolts can adjust the tension on the hoop and the tension of the drum head.

The drum head can be repeatedly struck with drumsticks, either on the head or simultaneously on the head and the hoop, which is known as a rimshot. When the drum is struck the hoop depresses slightly and provides a very small clearance from the underside of the lug bolt heads. Accordingly, the lug nuts can loosen in extremely small increments, such that during play, the drum will slowly go out of tune.

Unfortunately, it is impractical to tune a drum head repeatedly during performances. Accordingly, there is a need for a system that prevents the lug bolts from loosening to thereby keep a drum head in tune. Systems of this kind have been proposed, examples of which are set out as follows:

U.S. Pat. No. 6,747,199 to Shah, discloses a quick release lug system for drums. The mechanism enables quick removal of a drumhead and eliminates the need to unscrew multiple tuning rods. It does so by providing a cam lever that can be pulled down to lock the hoop on the drum body and tighten the drum head.

U.S. Pat. No. 5,208,412 to Hoshino teaches a mechanism for holding a drum head on a drum body by a drum hoop passing around the edge of the drum head. A lug on the side of the drum body has an axial opening, which receives a lug nut. The lug nut has an axial threaded opening. A threaded bolt, which engages the drum head hoop, is tightened into the threaded opening of the lug nut and draws the drum hoop to tighten the drum head. A radial opening extends radially through the lug nut from the opening in the lug to the threaded opening for the bolt. An elastic bolt engaging and bolt rotation resisting chip in the radial opening engages the lug on the outside and the bolt in the lug nut opening for restraining rotation of the bolt. There may be a drum head at each end of the drum body, a respective lug near each drum head and a single element defining both lug nuts.

U.S. Pat. No. 4,928,566 to Yanagisawa describes a pair of tension bolts that apply tension to a pair of drum heads screwed into nuts that are held by a pair of lug bodies fixed to a drum shell. The lug bodies are connected to one another by a connecting member with opposite ends fitted individually in openings at the respective end portions of the lug bodies. A hole is formed in each end portion of the connecting member. The lug bodies and the connecting member are connected so that projections on the lug bodies are fitted individually in the holes of the connecting member.

U.S. Pat. No. 4,506,586 to Brewer discloses a quick release drum head restraint including a pendulum and a toggle that enable a user to quickly remove and replace a drum head without significantly altering the tuning of the drum head.

U.S. Pat. No. 6,242,680 to Benton, Jr., teaches a drum tuning plates that distribute the drawing force exerted on the drumhead by the tensioning lugs. The tuning plates have a circumferential dimension substantially greater than the radial dimension and the thickness dimension and have an arcuate inner surface conforming to the radial contour of the drum hoop and an outer surface substantially parallel to the inner surface. Each tuning plate has an opening that enables it to be positioned between the head portion of one of the tensioning lugs and the drum hoop.

U.S. Pat. No. 5,977,463 to Bartlett shows a drum tuning mechanism having a pair of membrane mounting and tuning assemblies, one for each end of the shell. Each tuning assembly includes a lug casings that include a worm gear for turning and tightening tuning lugs disposed through the drum head hoop.

SUMMARY

The present disclosure includes a drum tuning stabilization system. The system can include a lug housing having an open internal portion, a first opening disposed along an upper surface, and a second opening disposed along a side surface, the lug housing being arranged and configured to attach to a side of a drum shell. The system can also include a tension rod elongate along a first axis, the tension rod having a first end and a second end opposite the first end that is threadably connected to a lower portion of the lug housing, wherein the tension rod extends from the lower portion of the lug housing up through the internal portion whereby second end of the tension rod extends outwardly from the first opening. In some embodiments, the system includes a locking tube slideably coupled to the tension rod, wherein the locking tube is arranged and configured to slide along a first direction and a second direction that is opposite the first direction, the first direction and the second direction being parallel to the first axis; and a lever arm rotatably coupled to the locking tube, the lever arm extending through the second opening of the lug housing, the lever arm being arranged and configured to move between a first position and a second position, wherein when the lever arm is in the first position, the locking tube is in a raised position along the first axis, and when the lever arm is in the second position, the locking tube is in a lowered position along the first axis. The second end of the tension rod can be arranged and configured to provide downward pressure to a top surface of a swivel hoop along the first axis. The locking tube can be arranged and configured to provide upward pressure to a bottom surface of the swivel hoop along the first axis.

In some embodiments, the system includes the drum shell defining an elongate annular shape, the lug housing being coupled to a side surface of the drum shell; a drum head covering an open end of the drum shell, wherein the drum head radially extends from a center of the open end of the drum shell to a periphery of the drum shell; and the swivel hoop defining an annular shape that is coupled to the periphery of the drum shell, wherein the swivel hoop covers at least a portion of the drum head and the periphery of the drum shell to thereby retain the drum head in a tuned position on the drum shell. In some embodiments, the swivel hoop comprises a first flange. Accordingly, the system can further include a tension rod washer coupled adjacent the second end of the tension rod, wherein the tension rod washer is arranged and configured to mechanically couple to the first flange.

The system can include a tension rod hat coupled to the second end of the tension rod, wherein the tension rod hat is arranged and configured to receive a key to thereby rotatably loosen the tension rod, and wherein when the tension rod hat is rotatably tightened the tension rod hat applies downward pressure to the tension rod washer along the first axis whereby the tension rod washer applies downward pressure to a top surface of the first flange along the first axis. The system can even include a PSI adjuster rotatably coupled to the locking tube and located adjacent to the bottom surface of the lug housing, wherein the PSI adjuster is arranged and configured to adjust the amount of upward pressure to a bottom surface of the first flange along the first axis. In some embodiments, the PSI adjuster is rotatably coupled to the locking tube and located adjacent to the upper surface of the lug housing.

In some embodiments, the system includes a rubber surface coupled between the lug housing and the drum shell; and a pair of screws and nuts located along an inside portion of the drum shell, wherein the pair of screws and nuts are arranged and configured to threadably couple the lug housing to the side of the drum shell. The system can further include a pair of nurlings that extend through the side surface of the drum shell, wherein the pair of nurlings respectively receive the pair of screws.

The lug housing can further comprise a third opening disposed along the side surface. In such embodiments, the system further includes a locking pin extending from the lever arm towards the side surface of the lug housing, wherein the locking pin is arranged and configured to protrude into the third opening and frictionally couple to a portion of the lug housing.

Even still, in some embodiments, the system includes a nylon insert embedded in the lug housing, wherein the nylon insert is arranged and configured to receive the locking pin and frictionally couple the locking pin to the lug housing. The system can include a bracket extending from the locking tube, wherein the lever arm is rotatably coupled to the bracket; and a lever pin that couples the lever arm to the bracket, wherein the lever pin allows the lever arm to rotate with respect to the bracket. The system can even include a pivot block located along the internal portion of the lug housing, wherein the pivot block receives a portion of the locking pin.

In some embodiments, the drum tuning stabilization system includes a locking cam located along the open internal portion of the lug housing, wherein the locking cam is operably coupled to the lever arm and the locking tube, such that when the lever arm is in the first position, the locking tube and the locking cam are in the raised position along the first axis, and when the lever arm is in the second position, the locking tube and the locking cam are in the lowered position.

Even still, in some embodiments, the drum tuning stabilization system includes a cam cradle located along the open internal portion of the lug housing, wherein the cam cradle receives the locking cam and the tension rod. The system can also include a tension rod lock unit extending from the locking tube, wherein the lever arm is rotatably coupled to the bracket. Furthermore, in some embodiments, the system includes a tension rod lock unit that lockably receives the tension rod adjacent the first end of the tension rod. In some embodiments, the tension rod lock unit prevents the tension rod from sliding out from the lug housing.

The present disclosure also includes a drum tuning stabilization system. The system can include a lug housing; a first tension rod elongate along a first axis, the first tension rod coupled to an internal portion of the lug housing and extending upward from the lug housing, wherein the first tension rod is arranged and configured to apply downward pressure to a first swivel hoop; a first locking tube slideably coupled to the first tension rod, the first locking tube arranged and configured to slide along the first axis, wherein the first locking tube is arranged and configured to apply upward pressure to the first swivel hoop; a first lever arm rotatably coupled to the first locking tube, the first lever arm extending outward from the lug housing and being arranged and configured to move between a first position and a second position, wherein when the first lever arm is in the first position, the first locking tube applies upward pressure to the first swivel hoop; a second tension rod elongate along a second axis, the second tension rod coupled to an internal portion of the lug housing and extending downward from the lug housing, wherein the second tension rod is arranged and configured to apply upward pressure to a second swivel hoop; a second locking tube slideably coupled to the second tension rod, the second locking tube arranged and configured to slide along the second axis, wherein the second locking tube is arranged and configured to apply downward pressure to the second swivel hoop; and a second lever arm rotatably coupled to the second locking tube, the second lever arm extending outward from the lug housing and being arranged and configured to move between a first position and a second position, wherein when the second lever arm is in the first position, the second locking tube applies downward pressure to the second swivel hoop.

The system can also include a drum shell having a side surface that receives the lug housing, a top drum head covering a top end of the drum shell, a top swivel hoop that couples the top drum head to the top end of the drum shell, a bottom drum head covering a bottom end of the drum shell, and a bottom swivel hoop that couples the bottom drum head to the bottom end of the drum shell. The first lever arm and the second lever arm can be located on opposite sides of the lug housing, and the first lever arm and the second lever arm rotate opposite each other.

The lug housing can define a first half and a second half located side by side, wherein the first tension rod extends through a first half of a top surface of the lug housing, and the second tension rod extends through a second half of a bottom surface of the lug housing.

The first locking tube can be located along the first half of the lug housing and a portion of the first locking tube is located along a first half of the internal portion of the lug housing, and wherein the second locking tube is located along the second half of the lug housing and a portion of the second locking tube is located along a second half of the internal portion of the lug housing.

In some embodiments, when the lever arm is in the first position, the tension rod is located in a first vertical position, and when the lever arm is in the second position, the tension rod remains in the first vertical position.

The present disclosure also includes a method of stabilizing a tune of a drum. The method can include coupling a swivel hoop to an open end of a drum shell; orienting the swivel hoop so that a first hole of a first flange of the swivel hoop receives a tension rod hat attached to a tension rod extending from a lug housing, wherein the lug housing is attached to a side of the drum shell; orienting the swivel hoop so that a second hole of the first flange is at least partially aligned with the tension rod hat; rotating the tension rod hat in a first rotation to thereby move the tension rod hat toward a top surface of the first flange; and moving a lever arm to a first position, wherein the lever arm is movably attached to the lug housing, to thereby move a locking tube extending from the lug housing toward a bottom surface of the first flange.

In some embodiments, when the tension rod hat contacts the top surface of the first flange and the locking tube contacts the bottom surface of the first flange, the swivel hoop is locked in place with respect to the drum shell. The method can also include rotating the tension rod hat in a second rotation that is opposite the first rotation to thereby move the tension rod hat away from the top surface of the first flange; and moving the lever arm to a second position to thereby move the locking tube away from the bottom surface of the first flange. The method can even include orienting the swivel hoop so that the first hole of the first flange is at least partially aligned with the tension rod hat; and decoupling the swivel hoop from the open end of the drum shell.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments.

DETAILED DESCRIPTION

Figure 1:
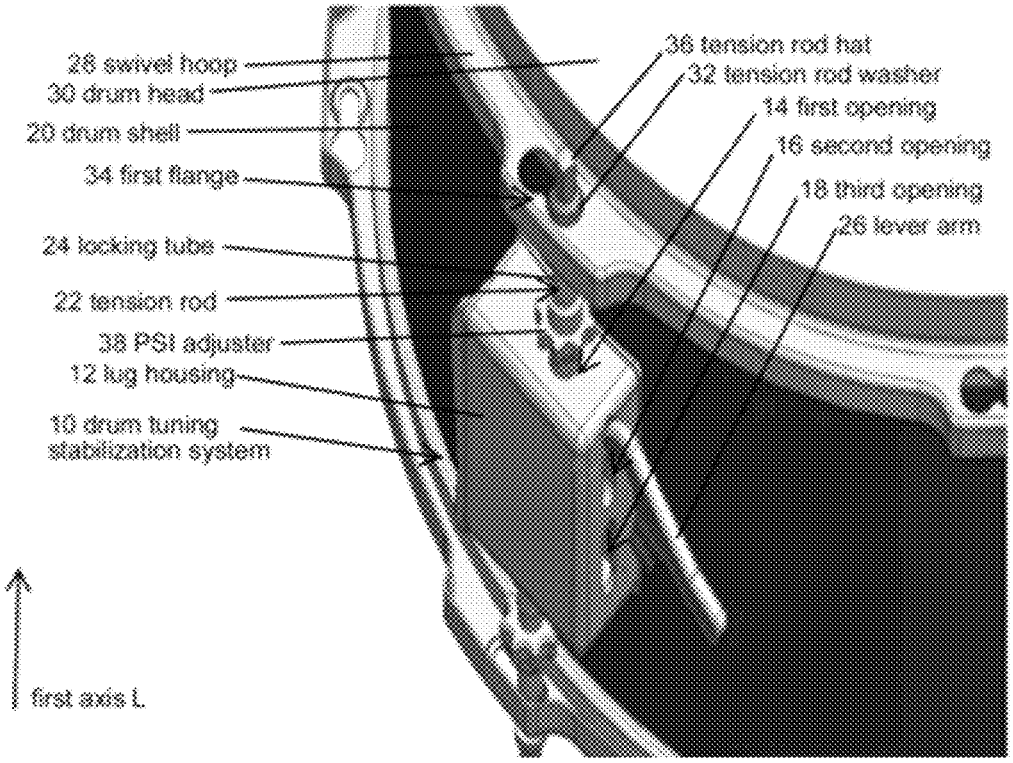
FIG. 1 illustrates a perspective view of a drum tuning stabilization system, according to some embodiments.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

LIST OF REFERENCE NUMERALS

10—Drum tuning stabilization system
12—Lug housing
14—First opening
16—Second opening
18—Third opening
20—Drum shell
22—Tension rod
24—Locking tube
26—Lever arm
28—Swivel hoop
30—Drum head
32—Tension rod washer
34—Flange
36—Tension rod hat
38—PSI adjuster
50—Rubber surface
52—Pair of screws and nuts
54—Nurlings
56—Locking pin
58—Nylon insert
60—Bracket
62—Locking pin
64—Pivot block
66—Locking cam
68—Cam cradle
70—Tension rod lock unit
72—First position
74—Raised position
76—Second position
78—Lowered position
80—First vertical position

INTRODUCTION

Conventional drums include a drum rim attached to a drum shell. The drum rim is locked in place using the standard a lug screw, and lug assembly, and thereby retains a drum head or skin in place. This drum assembly allows for a degree of the energy delivered by the drumstick impact to enter the resonant chamber. Tonal quality is a function of how well the part of the drum transmits the impact energy to the drum, and how much of that energy strike actually makes it into the resonant chamber.

The present invention improves the tonal quality of drums. Conventional drum components—including a drum shell, top and bottom drum heads, top and bottom rim hoops, drum lugs, and lug screws—do not form a solid inflexible energy and tone transfer unit. Accordingly, there is nothing to prevent the top hoop rim from flexing when struck by the stick, which can cause the top rim to flex or bend (the degree of which depends on materials used). The flexing or bending causes a portion of the energy from the impact of the stick on the rim to be deflected and thereby not transmitted to the drums resonant chamber. This loss of energy due to deflection reduces the tonal quality of the drum and also allows for the drum tuning to degrade over even short periods of time.

When the drum tuning stabilization system of the present invention is implemented into the drum lugs, lug screws, and/or shell, the drum rim becomes fixed in position. Once the drum is tuned and the lug screw locks are tightened into place the drum rim can no longer flex upon impact of the drum stick. When the component parts of the drum are solidly locked in their optimally tuned positions and no longer flex, they become a single solid piece of material. It should be appreciated that a solid material transmits sound energy more efficiently and with better tone than does a loose fitting assembly of parts that flex or move when struck.

The present invention can allow a drum to behave like a solid one-piece instrument, which can prevent reductions in drum head tensioning and prevent the upper hoop rim from flexing downward when struck. As such, the system can provide for 99% of the percussive impact energy to be transmitted directly to the drum's resonant chamber, thereby providing the optimal tone and volume from the drums resonant chamber during each and every stick impact.

The added benefit of the present invention is significant. Musical tone accounts for a great deal in music production. Great tone produces great musical recordings. As such, musicians, listeners, producers, and the like, greatly prefer instruments that stay in tune and generate outstanding tone quality. As such, the present invention can not only save time and money, but also it can allow a musician to precisely and repeatedly articulate a wide range of musical notes.

Drum Tuning Stabilization System Embodiments

As shown in FIG. 1, a drum tuning stabilization system 10 can include a lug housing 12 having an open internal portion. In some embodiments, the drum tuning stabilization system 10 ("system 10") includes a first opening 14 disposed along an upper surface and a second opening 16 disposed along a side surface. In many embodiments, the lug housing 12 is arranged and configured to attach to a side of a drum shell 20.

The system 10 can also include a tension rod 22 elongate along a first axis L. The tension rod 22 can have a first end that is threadably connected to a lower portion of the lug housing 12. The tension rod 22 can also have a second end opposite the first end. In some embodiments, the tension rod 22 extends from the lower portion of the lug housing 12 up through the internal portion whereby the second end of the tension rod 22 extends outwardly from the first opening 14.

With continued reference to FIG. 1, the system 10 includes a locking tube 24 slideably coupled to the tension rod 22. The locking tube can be arranged and configured to slide along a first direction and a second direction that is opposite the first direction. The first direction and the second direction can both be parallel to the first axis L.

In some embodiments, the system 10 includes a lever arm 26 rotatably coupled to the locking tube 24. The lever arm 26 can extend through the second opening 16 of the lug housing 12. The lever arm 26 can be arranged and configured to move between a first position and a second position. When the lever arm 26 is in the first position, the locking tube 24 can be in a raised position along the first axis L whereby the locking tube 24 contacts a bottom surface of a swivel hoop 28 of a drum. In this manner, the locking tube 24 can apply upward pressure on the bottom surface of the swivel hoop 28, at the first flange 34. As well, when the lever arm 26 is in the second position, the locking tube 24 can be in a lowered position along the first axis L whereby the locking tube 24 does not contact the swivel hoop 28. In this regard, the swivel hoop 28 can be free to move with respect to the locking tube 24.

In order to lock the swivel hoop 28 in place with respect to the locking tube 24 and the tension rod 22, the tension rod 22 can be configured to rotate such that it lowers along the first axis L to thereby come into contact with the swivel hoop 28. In this manner, the swivel hoop 28 is locked in place by the upward pressure of the locking tube 24 and the downward pressure of the tension rod 22.

Figure 2:
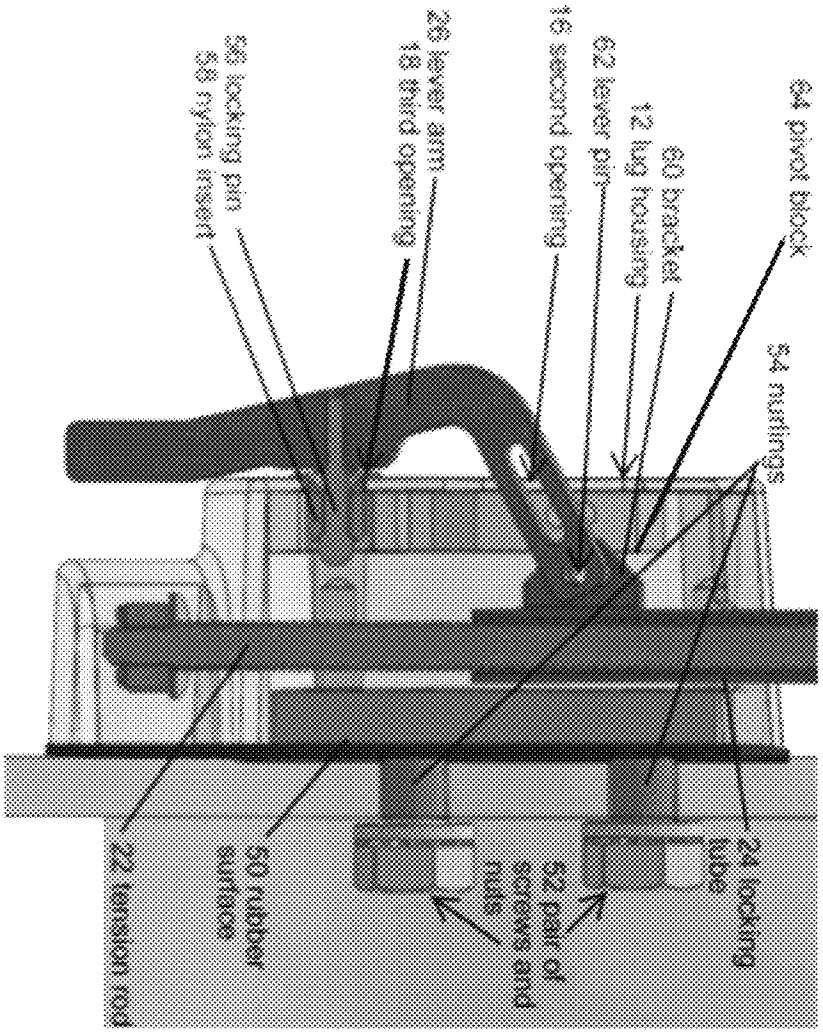
FIG. 2 illustrates a cross-section view of a drum tuning stabilization system, according to some embodiments.
Figure 3:
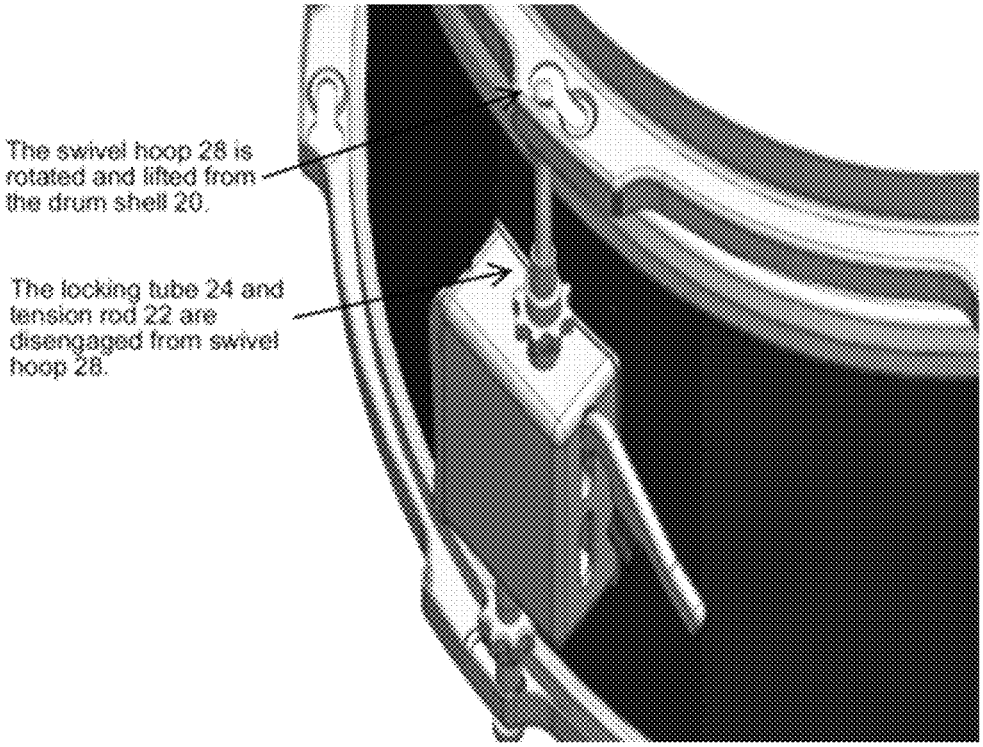
FIG. 3 illustrates a perspective view of a drum tuning stabilization system, according to some embodiments.

As shown in FIGS. 1 and 2, the system 10 can include a drum shell 20, which can define an elongate annular shape. In this manner, the lug housing 12 can be coupled to a side surface of the drum shell 20. The system 10 can also include a drum head 30 that covers an open end of the drum shell 20. Described further, the drum head 30 can radially extend from a center of the open end of the drum shell 20 to a periphery of the drum shell 20. The system 10 can also include the swivel hoop 28, which can define an annular shape that is coupled to the periphery of the drum shell 20. The swivel hoop 28 can cover at least a portion of the drum head 30 and the periphery of the drum shell 20 to thereby retain the drum head 30 in a tuned position on the drum shell 20.

As further illustrated in FIG. 1, the swivel hoop 28 can comprise a first flange 34. Accordingly, the system 10 can further comprise a tension rod washer 32 coupled adjacent the second end of the tension rod 22. In some embodiments, the tension rod washer 32 is arranged and configured to mechanically couple to the first flange 34 and apply the downward pressure as described above.

The system 10 can further include a tension rod hat 36 coupled to the second end of the tension rod 22. The tension rod hat 36 can be arranged and configured to receive a key, which can be used to rotatably loosen the tension rod 22. Accordingly, when the tension rod hat is rotatably tightened the tension rod hat 36 can apply downward pressure to the tension rod washer 32 along the first axis L. The tension rod washer 32 can thereby apply downward pressure to a top surface of the first flange 34 along the first axis L.

As shown in FIG. 1, the system 10 can further include a pounds per square inch adjuster 38 ("PSI adjuster") rotatably coupled to the locking tube 24 and located adjacent to the upper surface of the lug housing 12. The PSI adjuster 38 can be arranged and configured to adjust the amount of upward pressure applied on the bottom surface of the first flange 34 along the first axis L. The PSI adjuster 38 can be used to provide fine adjustment to the locking tube 24 and the pressure applied to the underside of the rim hoop 28.

As shown in FIG. 2, the system 10 can also include a rubber surface 50 coupled between the lug housing 12 and the drum shell 20. The rubber surface 50 can provide a cushioned surface that can dampen vibration and resonance from the drum shell 20 to the lug housing 12. In some embodiments, the system 10 also includes a pair of screws and nuts 52 located along an inside portion of the drum shell 10. The pair of screws and nuts 52 can be arranged and configured to threadably couple the lug housing 12 to the side of the drum shell 20. The system 10 can also include a pair of nurlings 54 that extend through the side surface of the drum shell 20. The pair of nurlings 54 receive the pair of screws 52.

Now, with reference to FIG. 1, the lug housing 12 can further comprise a third opening 18 disposed along the side surface. Accordingly, the system 10 can further include a locking pin 56 extending from the lever arm 26 towards the side surface of the lug housing 12. The locking pin 56 can be arranged and configured to protrude into the third opening 18 whereby the locking pin 56 frictionally couples to a portion of the lug housing 12.

In some embodiments, the system 10 includes a nylon insert 58 which can be embedded in the lug housing 12. The nylon insert 58 can be arranged and configured to receive the locking pin 56. Accordingly, the locking pin 56 can frictionally couple the locking pin 56 to the lug housing 12.

Even still, in some embodiments, the system 10 includes a bracket 60 extending from the locking tube 24. The lever arm 26 can be rotatably coupled to the bracket 60. Accordingly, the system 10 can include a lever pin 62 that couples the lever arm 26 to the bracket 60. In some embodiments, the lever pin 62 allows the lever arm 26 to rotate with respect to the bracket 60. As further shown in FIG. 2, the system can include a pivot block 64 located along the internal portion of the lug housing 12. In some embodiments, the pivot block 64 can receive a portion of the locking pin 56.

Figure 4:
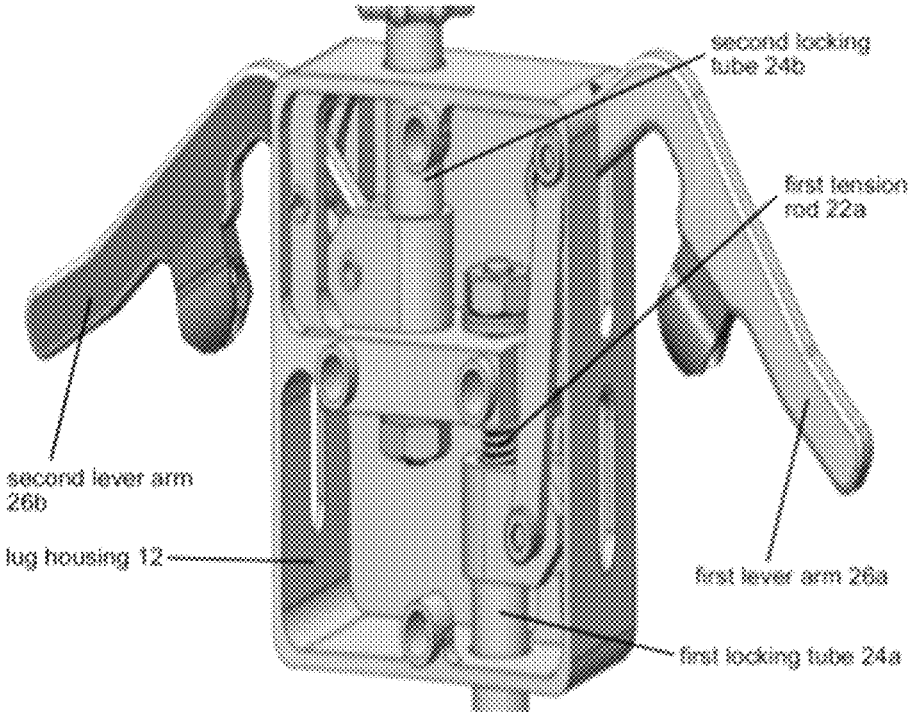
FIG. 4 illustrates a cross-section view of a drum tuning stabilization system, according to some embodiments.
Figure 5:
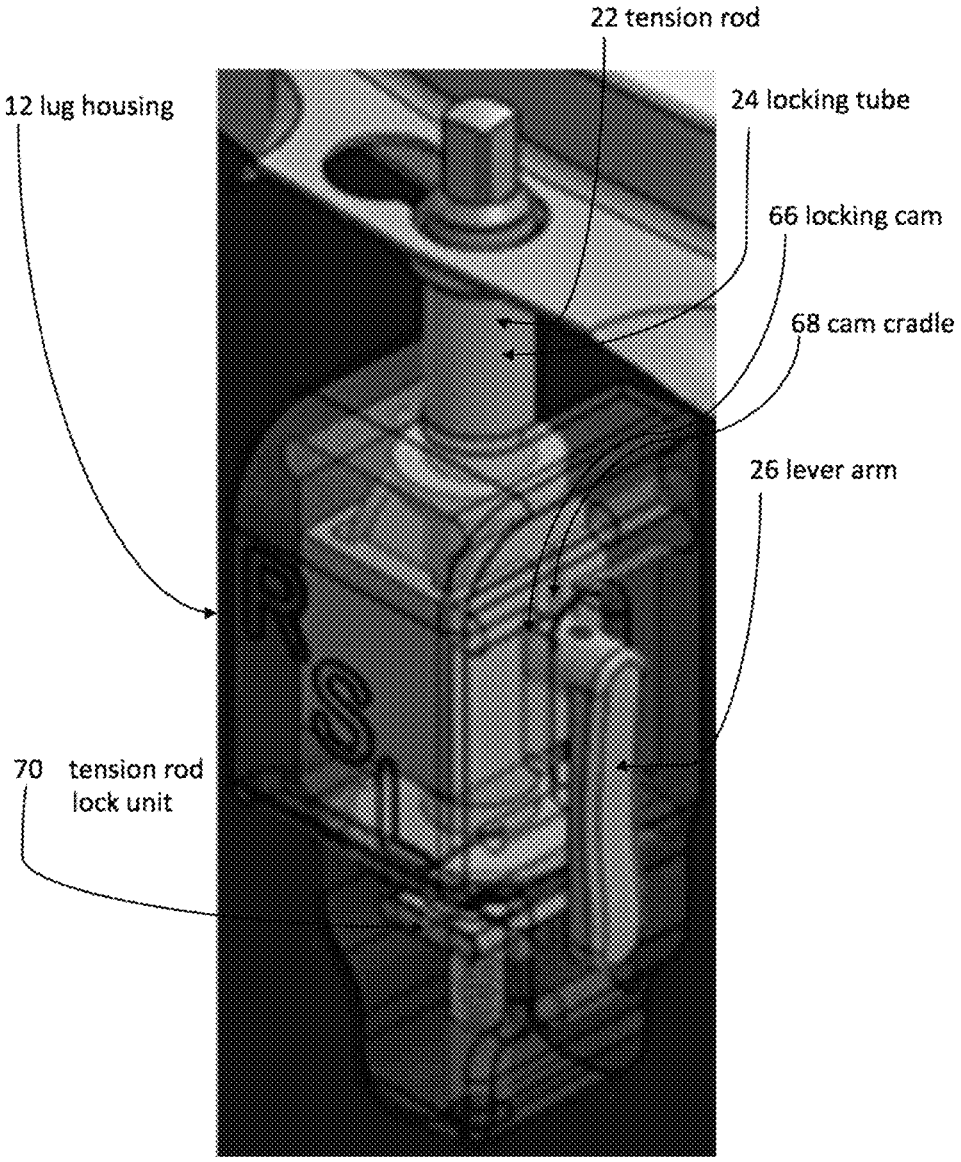
FIG. 5 illustrates a perspective view of a drum tuning stabilization system, according to some embodiments.
Figure 6:
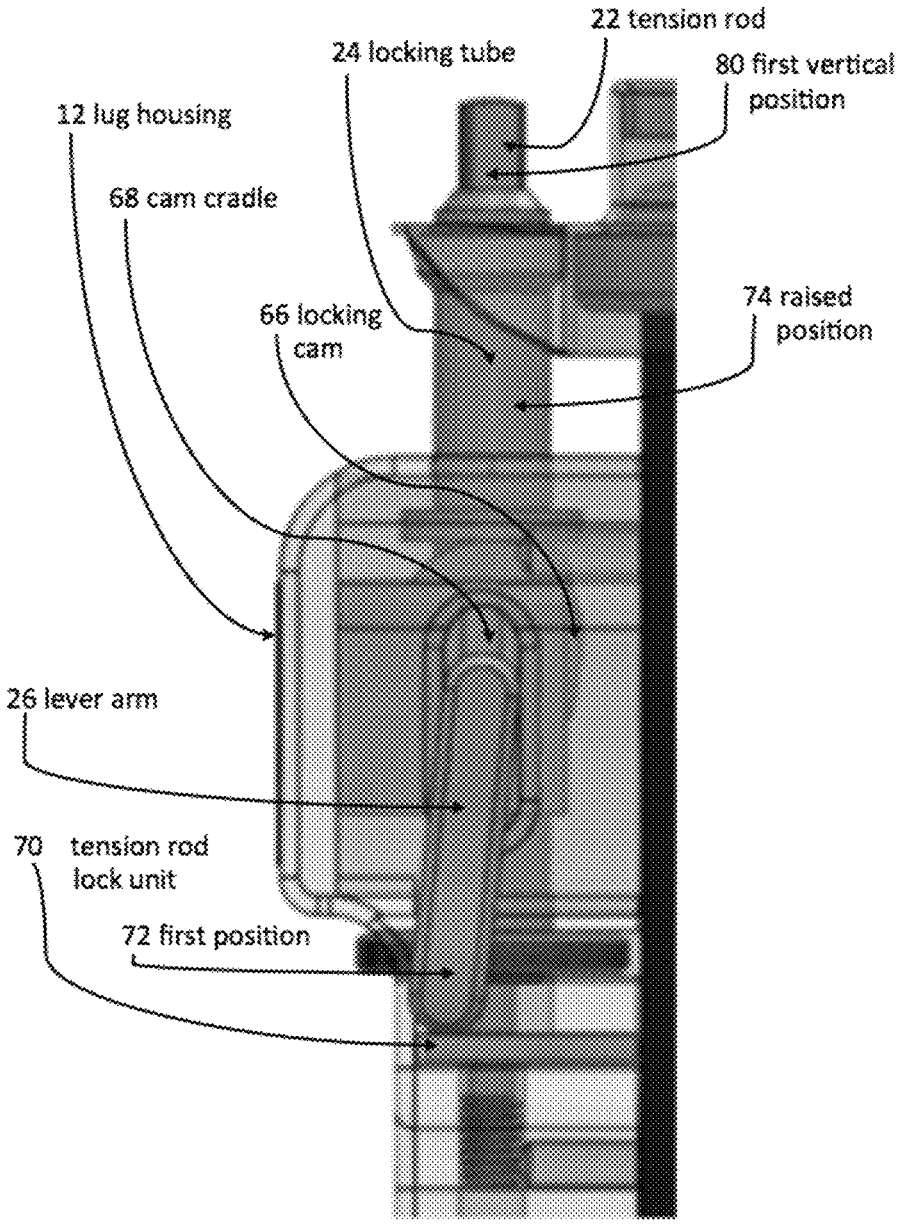
FIG. 6 illustrates a side view of a drum tuning stabilization system with a locking tube in the raised position, according to some embodiments.
Figure 7:
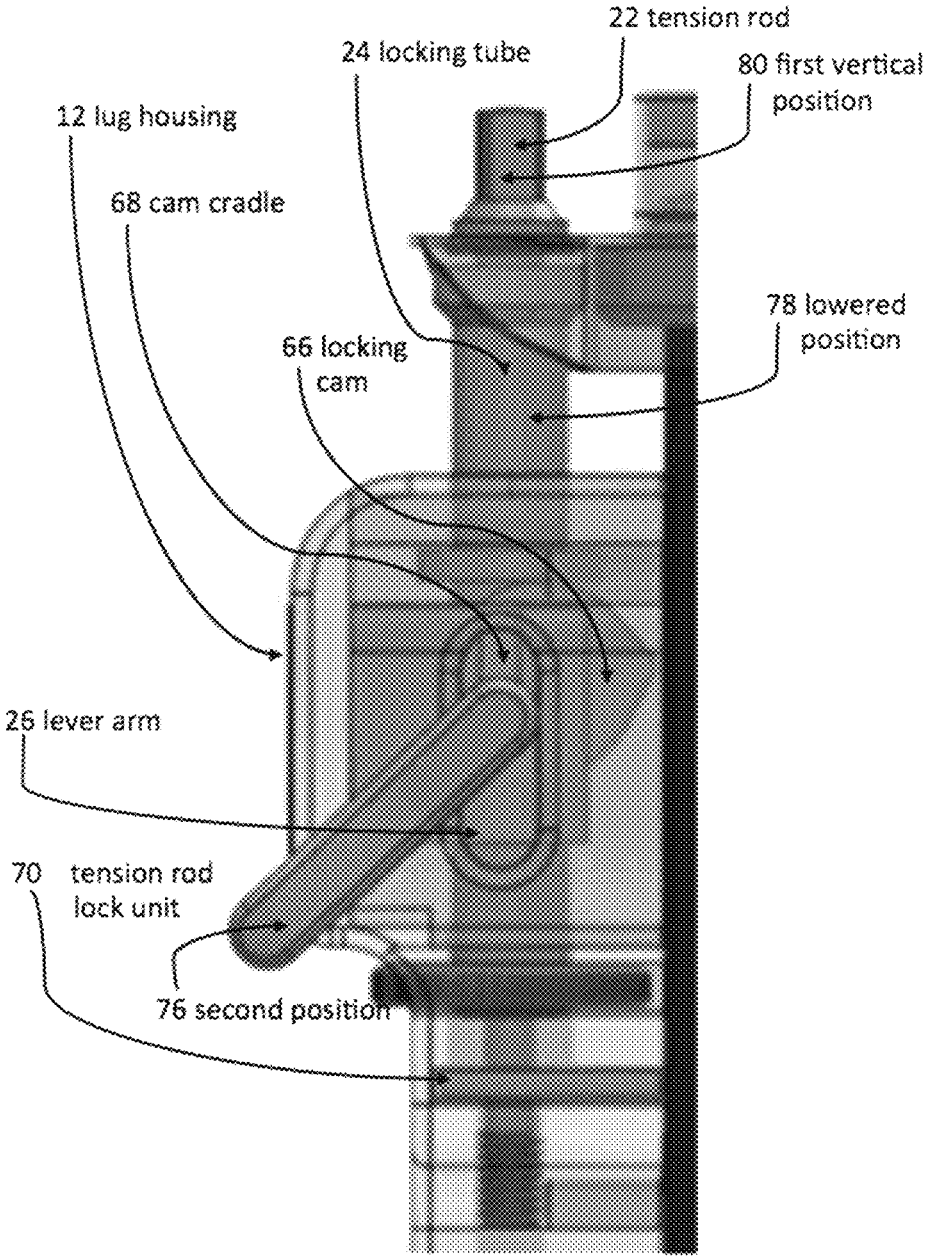
FIG. 7 illustrates a side view of a drum tuning stabilization system with a locking tube in the lowered position, according to some embodiments.
Figure 8:
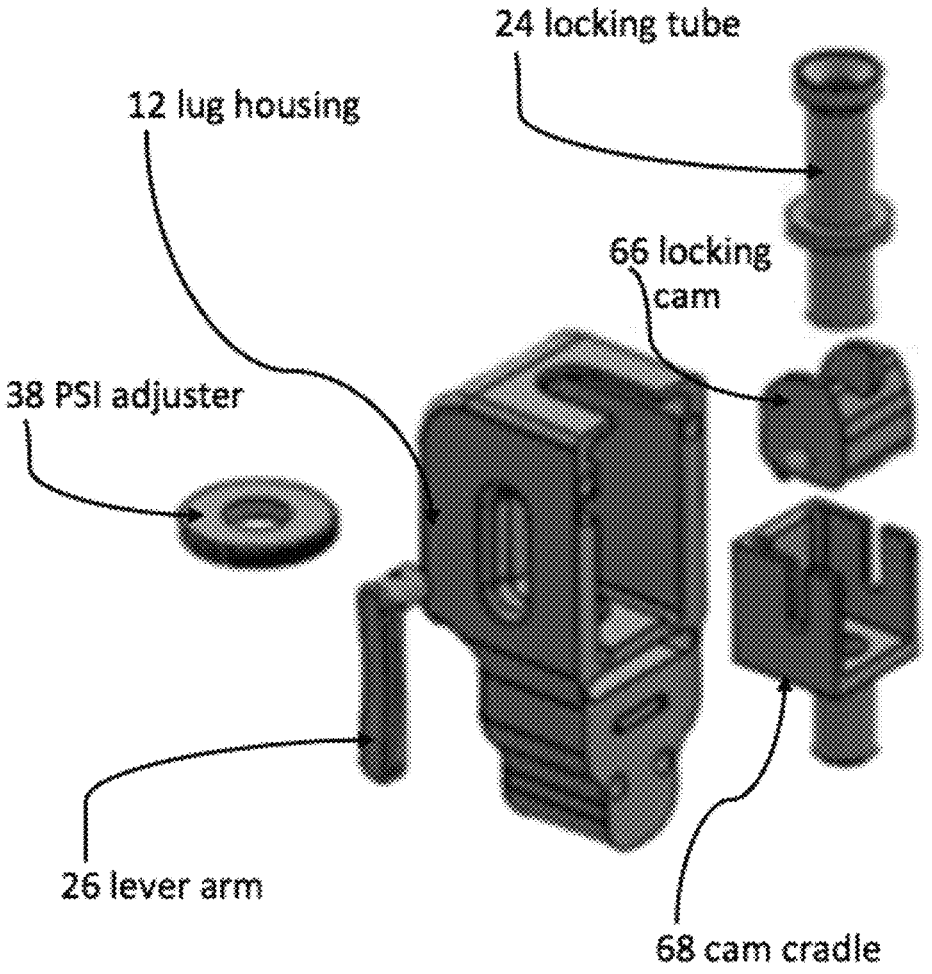
FIG. 8 illustrates an exploded view of a lug housing and the components located inside the lug housing, according to some embodiments.

Some drums include a top drum head 30*a* and a bottom drum head 30*b* that faces opposite the top drum head 30*a*. As shown in FIG. 4, the system 10 can thereby include additional components, such as multiple tension rods 22, multiple locking tubes 24, multiple lever arms 26, and the like. The additional components can be used to stabilize tuning of drums with top and bottom drum heads 30*a*, 30*b*.

Accordingly, in some embodiments, the system 10 includes a first tension rod 22*a* elongate along a first axis L. The first tension rod 22*a* can be coupled to an internal portion of the lug housing 12 whereby it extends upward from the lug housing 12. The first tension rod 22*a* can be arranged and configured to apply downward pressure to a first swivel hoop 28*a*.

The system can also include a first locking tube 24*a* slideably coupled to the first tension rod 22*a*. The first locking tube 24*a* can be arranged and configured to slide along the first axis L1. Accordingly, the first locking tube 24*a* can be arranged and configured to apply upward pressure to the first swivel hoop 28*a*.

In some embodiments, the system 10 includes a first lever arm 26*a* rotatably coupled to the first locking tube 24*a*. The first lever arm 26*a* can extend outward from the lug housing 12. Additionally, the first lever arm 26*a* can be arranged and configured to move between a first position and a second position. When the first lever arm 26*a* is in the first position, the first locking tube 24*a* can apply upward pressure to the first swivel hoop 28*a*.

The system 10 can also include a second tension rod 22*b* elongate along a second axis L2. The second tension rod 22*b* can be coupled to an internal portion of the lug housing 12 whereby it extends downward from the lug housing 12. The second tension rod 22*b* can be arranged and configured to apply upward pressure to a second swivel hoop 28*b*.

In some embodiments, the system 10 includes a second locking tube 24*b* slideably coupled to the second tension rod 22*b*. The second locking tube 24*b* can be arranged and configured to slide along the second axis L2. Accordingly, the second locking tube 24*b* can be arranged and configured to apply downward pressure to the second swivel hoop 28*b*.

The system 10 can include a second lever arm 26*b* rotatably coupled to the second locking tube 24*b*. The second lever arm 26*b* can extend outward from the lug housing 12 whereby it can be arranged and configured to move between a first position and a second position. When the second lever arm 26*b* is in the first position, the second locking tube 24*b* can apply downward pressure to the second swivel hoop 28*b*.

In some embodiments, the system 10 can include a drum shell 20 having a side surface that receives the lug housing 12. The system 10 can also include a top drum head 30*a* that covers a top end of the drum shell 20, a top swivel hoop 28*a* that couples the top drum head 30*a* to the top end of the drum shell 20. The system 10 can also include a bottom drum head 30*b* that covers a bottom end of the drum shell 20, and a bottom swivel hoop 28*b* that couples the bottom drum head 30*b* to the bottom end of the drum shell 20.

In some embodiments, the first lever arm 26*a* and the second lever arm 26*b* are located on opposite sides of the lug housing 12. Accordingly, the first lever arm 26*a* and the second lever arm 26*b* can rotate opposite each other. In some embodiments, the lug housing 12 defines a first half and a second half located side by side. The first tension rod 22*a* can extend through a first half of a top surface of the lug housing 12, while the second tension rod 22*b* can extend through a second half of a bottom surface of the lug housing 12.

Even still, in some embodiments, the first locking tube 24*a* is located along the first half of the lug housing 12 whereby a portion of the first locking tube 24*a* is located along a first half of the internal portion of the lug housing 12. The second locking tube 24*b* can be located along the second half of the lug housing 12 whereby a portion of the second locking tube 24*b* is located along a second half of the internal portion of the lug housing 12.

As illustrated in FIGS. 5-8, the drum tuning stabilization system 10 can also include a locking cam 66 located along the open internal portion of the lug housing 12. The locking cam 66 can be operably coupled to the lever arm 26 and the locking tube 24. In some embodiments, when the lever arm 26 is in the first position 72, the locking tube 24 is in the raised position 74 along the first axis L. Also, when the lever arm 26 is in the second position 76, the locking tube 24 is in the lowered position 78. As such, the locking cam 66 can act as the on/off lock set for the drum lug and rim hoop whereby the locking cam 66 can raise/lower the locking tube 24 between the raised and lowered positions 74, 78. Additionally, in some embodiments, when the lever arm 26 is in the first position 72, the tension rod 22 is located in a first vertical position 80, and when the lever arm 26 is in the second position 76, the tension rod 22 remains in the first vertical position 80.

As further shown in FIGS. 5-8, the system 10 can include a cam cradle 68 located along the open internal portion of the lug housing 12. The cam cradle 68 can receive the locking cam 66 and the tension rod 22. The cam cradle 68 can act as an adjustable seat for the locking cam 66. Additionally, in some embodiments, the system 10 includes a tension rod lock unit 70 that lockably receives the tension rod 22 adjacent the first end of the tension rod 22. The tension rod lock unit 70 can thereby prevent the tension rod 22 from sliding out from the lug housing 12.

Drum Tuning Stabilization Method Embodiments

Figure 9:
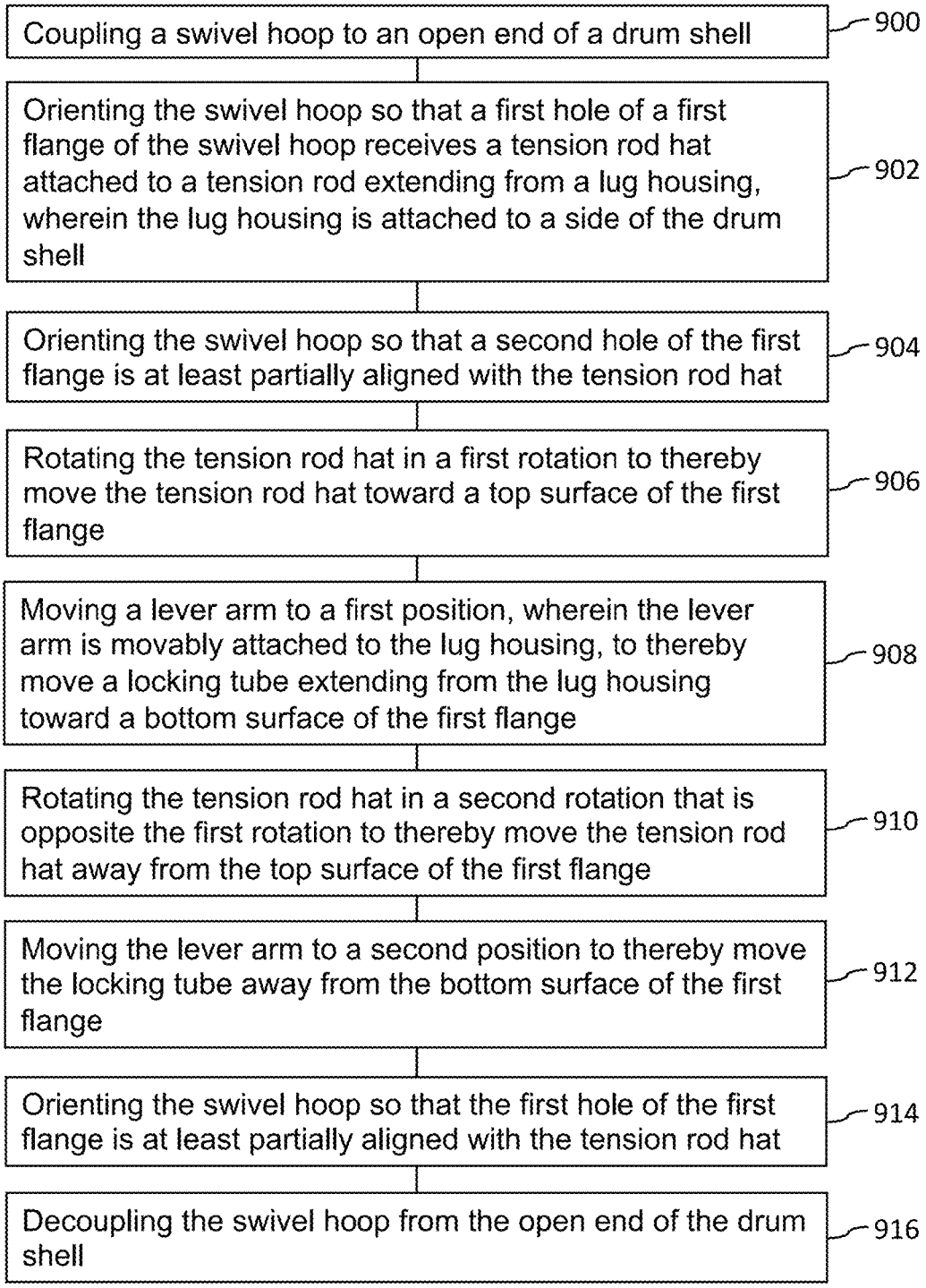
FIG. 9 illustrates a flow diagram of a method for using a drum tuning stabilization system, according to some embodiments.

The disclosure also includes methods for using the system 20 to stabilize a tune of a drum. As shown in FIG. 9, the method includes coupling a swivel hoop 28 to an open end of a drum shell 20 (at step 900). The method can also include orienting the swivel hoop 28 so that a first hole of a first flange 34 of the swivel hoop 28 receives a tension rod hat 32 attached to a tension rod 22 extending from a lug housing 22 (at step 902). The method can include orienting the swivel hoop 28 so that a second hole of the first flange 34 is at least partially aligned with the tension rod hat 32 (at step 904). Methods can even include rotating the tension rod hat 32 in a first rotation to thereby move the tension rod hat 32 toward a top surface of the first flange 34 (at step 906). In some embodiments, the method includes moving a lever arm 26 to a first position, wherein the lever arm 26 is movably attached to the lug housing 12, to thereby move a locking tube 24 extending from the lug housing 12 toward a bottom surface of the first flange 34 (at step 908).

In some embodiments, the method includes rotating the tension rod hat 32 in a second rotation that is opposite the first rotation to thereby move the tension rod hat 32 away from the top surface of the first flange 34 (at step 910). The method can even include moving the lever arm 26 to a second position to thereby move the locking tube 24 away from the bottom surface of the first flange 34 (at step 912).

Methods can also include orienting the swivel hoop 28 so that the first hole of the first flange 34 is at least partially aligned with the tension rod hat 32 (at step 914). Accordingly, methods can include decoupling the swivel hoop 28 from the open end of the drum shell 20 (at step 916).

Interpretation

None of the steps or limitations described herein is essential or indispensable. Any of the steps or limitations can be adjusted or modified. Other or additional steps and/or limitations can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

The following is claimed:

1. A drum tuning stabilization system, comprising:

a lug housing having an open internal portion, a first opening disposed along an upper surface, and a second opening disposed along a side surface, the lug housing being arranged and configured to attach to a side of a drum shell;

a tension rod elongate along a first axis, the tension rod having a first end and a second end opposite the first end that is threadably connected to a lower portion of the lug housing, wherein the tension rod extends from the lower portion of the lug housing up through the internal portion whereby the second end of the tension rod extends outwardly from the first opening;

a locking tube slideably coupled to the tension rod, wherein the locking tube is arranged and configured to slide along a first direction and a second direction that is opposite the first direction, the first direction and the second direction being parallel to the first axis; and a lever arm rotatably coupled to the locking tube, the lever arm extending through the second opening of the lug housing, the lever arm being arranged and configured to move between a first position and a second position, wherein when the lever arm is in the first position, the locking tube is in a raised position along the first axis, and when the lever arm is in the second position, the locking tube is in a lowered position along the first axis, wherein the second end of the tension rod is arranged and configured to provide downward pressure to a top surface of a swivel hoop along the first axis, and wherein the locking tube is arranged and configured to provide upward pressure to a bottom surface of the swivel hoop along the first axis.

2. The drum tuning stabilization system of claim 1, further comprising:

the drum shell defining an elongate annular shape, the lug housing being coupled to a side surface of the drum shell;

a drum head covering an open end of the drum shell, wherein the drum head radially extends from a center of the open end of the drum shell to a periphery of the drum shell; and the swivel hoop defining an annular shape that is coupled to the periphery of the drum shell, wherein the swivel hoop covers at least a portion of the drum head and the periphery of the drum shell to thereby retain the drum head in a tuned position on the drum shell.

3. The drum tuning stabilization system of claim 2, wherein the swivel hoop comprises a first flange, the system further comprising a tension rod washer coupled adjacent the second end of the tension rod, wherein the tension rod washer is arranged and configured to mechanically couple to the first flange.

4. The drum tuning stabilization system of claim 3, further comprising a tension rod hat coupled to the second end of the tension rod, wherein the tension rod hat is arranged and configured to receive a key to thereby rotatably loosen the tension rod, and wherein when the tension rod hat is rotatably tightened the tension rod hat applies downward pressure to the tension rod washer along the first axis whereby the tension rod washer applies downward pressure to a top surface of the first flange along the first axis.

5. The drum tuning stabilization system of claim 4, further comprising a PSI adjuster rotatably coupled to the locking tube and located adjacent to the bottom surface of the lug housing, wherein the PSI adjuster is arranged and configured to adjust the amount of upward pressure to a bottom surface of the first flange along the first axis.

6. The drum tuning stabilization system of claim 3, further comprising:

a rubber surface coupled between the lug housing and the drum shell; and a pair of screws and nuts located along an inside portion of the drum shell, wherein the pair of screws and nuts are arranged and configured to threadably couple the lug housing to the side of the drum shell.

7. The drum tuning stabilization system of claim 6, further comprising a pair of nurlings that extend through the side surface of the drum shell, wherein the pair of nurlings respectively receive the pair of screws.

8. The drum tuning stabilization system of claim 1, further comprising a locking cam located along the open internal portion of the lug housing, wherein the locking cam is operably coupled to the lever arm and the locking tube, such that when the lever arm is in the first position, the locking tube and the locking cam are in the raised position along the first axis, and when the lever arm is in the second position, the locking tube and the locking cam are in the lowered position.

9. The drum tuning stabilization system of claim 8, further comprising a cam cradle located along the open internal portion of the lug housing, wherein the cam cradle receives the locking cam and the tension rod.

10. The drum tuning stabilization system of claim 1, further comprising a tension rod lock unit that lockably receives the tension rod adjacent the first end of the tension rod, wherein the tension rod lock unit prevents the tension rod from sliding out from the lug housing.

11. The drum tuning stabilization system of claim 1, wherein when the lever arm is in the first position, the tension rod is located in a first vertical position, and when the lever arm is in the second position, the tension rod remains in the first vertical position.

12. A drum tuning stabilization system, comprising:

a lug housing;

a first tension rod elongate along a first axis, the first tension rod coupled to an internal portion of the lug housing and extending upward from the lug housing, wherein the first tension rod is arranged and configured to apply downward pressure to a first swivel hoop;

a first locking tube slideably coupled to the first tension rod, the first locking tube arranged and configured to slide along the first axis, wherein the first locking tube is arranged and configured to apply upward pressure to the first swivel hoop;

a first lever arm rotatably coupled to the first locking tube, the first lever arm extending outward from the lug housing and being arranged and configured to move between a first position and a second position, wherein when the first lever arm is in the first position, the first locking tube applies upward pressure to the first swivel hoop;

a second tension rod elongate along a second axis, the second tension rod coupled to an internal portion of the lug housing and extending downward from the lug housing, wherein the second tension rod is arranged and configured to apply upward pressure to a second swivel hoop;

a second locking tube slideably coupled to the second tension rod, the second locking tube arranged and configured to slide along the second axis, wherein the second locking tube is arranged and configured to apply downward pressure to the second swivel hoop; and a second lever arm rotatably coupled to the second locking tube, the second lever arm extending outward from the lug housing and being arranged and configured to move between a first position and a second position, wherein when the second lever arm is in the first position, the second locking tube applies downward pressure to the second swivel hoop.

13. The drum tuning stabilization system of claim 12, comprising a drum shell having a side surface that receives the lug housing, a top drum head covering a top end of the drum shell, a top swivel hoop that couples the top drum head to the top end of the drum shell, a bottom drum head covering a bottom end of the drum shell, and a bottom swivel hoop that couples the bottom drum head to the bottom end of the drum shell.

14. The drum tuning stabilization system of claim 13, wherein the first lever arm and the second lever arm are located on opposite sides of the lug housing, and wherein the first lever arm and the second lever arm rotate opposite each other.

15. The drum tuning stabilization system of claim 14, wherein the lug housing defines a first half and a second half located side by side, wherein the first tension rod extends through a first half of a top surface of the lug housing, and the second tension rod extends through a second half of a bottom surface of the lug housing.

16. The drum tuning stabilization system of claim 15, wherein the first locking tube is located along the first half of the lug housing and a portion of the first locking tube is located along a first half of the internal portion of the lug housing, and wherein the second locking tube is located along the second half of the lug housing and a portion of the second locking tube is located along a second half of the internal portion of the lug housing.

17. A method of stabilizing a tune of a drum, comprising:

coupling a swivel hoop to an open end of a drum shell;

orienting the swivel hoop so that a first hole of a first flange of the swivel hoop receives a tension rod hat attached to a tension rod extending from a lug housing, wherein the lug housing is attached to a side of the drum shell;

orienting the swivel hoop so that a second hole of the first flange is at least partially aligned with the tension rod hat;

rotating the tension rod hat in a first rotation to thereby move the tension rod hat toward a top surface of the first flange; and moving a lever arm to a first position, wherein the lever arm is movably attached to the lug housing, to thereby move a locking tube extending from the lug housing toward a bottom surface of the first flange.

18. The method of claim 17, wherein when the tension rod hat contacts the top surface of the first flange and the locking tube contacts the bottom surface of the first flange, the swivel hoop is locked in place with respect to the drum shell.

19. The method of claim 18, further comprising:

rotating the tension rod hat in a second rotation that is opposite the first rotation to thereby move the tension rod hat away from the top surface of the first flange; and moving the lever arm to a second position to thereby move the locking tube away from the bottom surface of the first flange.

20. The method of claim 19, further comprising:

orienting the swivel hoop so that the first hole of the first flange is at least partially aligned with the tension rod hat; and decoupling the swivel hoop from the open end of the drum shell.

* * * * *